United States Patent [19]

Prüm

[11] Patent Number: 5,004,451

[45] Date of Patent: Apr. 2, 1991

[54] FOLDING APPARATUS WITH IMPROVED WEB TRANSPORT

[75] Inventor: Sebastian Prüm, Kaiserslautern, Fed. Rep. of Germany

[73] Assignee: Albert-Frankenthal AG, Frankenthal, Fed. Rep. of Germany

[21] Appl. No.: 477,437

[22] Filed: Jan. 18, 1990

[30] Foreign Application Priority Data

Feb. 11, 1989 [DE] Fed. Rep. of Germany ..... 3904076

[51] Int. Cl.[5] ..... B31F 1/00; B31F 7/00

[52] U.S. Cl. ..... 493/359; 493/360; 493/418; 493/424; 493/460

[58] Field of Search ..... 493/356, 357, 358, 359, 493/360, 418, 424, 425, 426, 427, 428, 429, 460, 461, 369, 370, 416, 450

[56] References Cited

U.S. PATENT DOCUMENTS

| | | | |
|---|---|---|---|
| 1,974,149 | 9/1934 | Christman | 493/418 |
| 3,010,260 | 11/1961 | Subklew | 493/342 |
| 3,274,871 | 9/1966 | Ehlscheid | 83/99 |
| 3,363,896 | 1/1968 | McKindary | 493/418 |
| 3,506,255 | 4/1970 | Jahn et al. | 493/418 |
| 4,537,588 | 8/1985 | Ehlscheid et al. | 493/342 |
| 4,842,574 | 6/1989 | Noble | 493/461 |

FOREIGN PATENT DOCUMENTS

| | | |
|---|---|---|
| 1611292 | 12/1970 | Fed. Rep. of Germany . |
| 1214339 | 12/1970 | United Kingdom . |

*Primary Examiner*—Frederick R. Schmidt
*Assistant Examiner*—John A. Marlott
*Attorney, Agent, or Firm*—Harrison & Egbert

[57] ABSTRACT

A folder comprising a knife cylinder adapted to be driven at a rate independent of the speed of the web being supplied, a mating cylinder adapted to cooperate with said knife cylinder in cutting a web into sections at a cutting nip and which is provided with grippers for the leading edges of the sections, and a belt conveyor belt trained around a part of the circumference of said mating cylinder following said nip. It is possible to ensure more accurate production and greater reliability if the folder is so designed that it includes at least one of the cylinders delimiting said cutting nip and having suction or blowing ports placed following the cutting means, such ports being adapted for causing a flow of air towards the cylinder having said grippers.

8 Claims, 2 Drawing Sheets

FOLDING APPARATUS WITH IMPROVED WEB TRANSPORT

BACKGROUND OF THE INVENTION

The invention relates to a folder comprising a knife cylinder adapted to be driven at a rate independent of the speed of the web being supplied, a mating cylinder adapted to cooperate with said knife cylinder in cutting the web into sections at a cutting nip and which is provided with grippers for the leading edges of the sections, an a belt conveyor belt trained around a part of the circumference of said mating cylinder following said nip.

This design of folder is a described in the German patent No. 1,611,292. In folders of this type there is the advantage that the web may be cut to different sizes without having to have a transverse cutter, normally required in adjustable folders, with a following accelerating path. Owing to the difference in speed between the web and the cylinders having the cutting means it is necessary for the products to be severed at their trailing edges from the web even prior to the engagement by the grippers of the leading end of such web sections. The consequence of this is that the leading web end produced each time a cut is made, is not guided or held before it is engaged by the conveyor belt, that is to say at a point in the gap of increasing width the point of cutting and the start of the conveyor belt. There is thus the danger of such front run assuming a curled form, this being prone to lead to irregular folding in the course of later processing.

SUMMARY OF THE INVENTION

Taking this state of the art as a starting point, one object of the present invention is to provide a folder of the initially mentioned type which is so improved using simple and low-cost means that highly regular production is ensured.

In order to attain this or other objects appearing from the present specification, claims and drawings, the folder is so designed that at least one cylinder delimiting said cutting nip has suction or blowing ports placed following the cutting means, such ports being adapted for causing a flow of air towards the cylinder having said grippers.

These measures ensure that even before it engages the conveyor belt the new start or leading edge of the web produced each time a cut is made is reliably pressed into engagement with the cylinder having the grippers and accordingly is taken up by the conveyor belt in a straightened, non-curled condition so that accurate folding and high quality of production are ensured. Thus, for the first time, the features of the invention ensure the practical application of a folder of the generic type so as to maintain the advantages therefore while at the same time avoiding the disadvantages indicated.

In accordance whith a further advantageous development of the invention it is possible for at least the knife cylinder to be provided with blowing ports in the part following the knives and which are directed towards the opposite cylinder and which are provided with means for connection with a source of compressed air. The use of compressed air for urging the leading part of the web against the cylinder provided with grippers leads to a particulary simple and realiably operating arrangement. At the same time these features involve the presence of a certain air cushion between the web and the machine parts which normally move faster, this leading to a more gentle handling of the web material.

In accordance with a further possible feature in accordance with the invention means are provided for turning on the ports when they are moving through the cutting nip and the gap of increasing width coming thereafter and for turning them off when they have left it. This means that the power consumption may be restricted. At the same time the design ensures that other operation taking place on the web etc. are not interfered with by compressed air.

As part of one form of the invention which is particularly to be preferred it is possible to have a stationary deflector means in the said gap of increasing width and ahead of tha conveyor belt, said deflector means consisting of adjacent deflecting lugs with spaces in between them, and so arranged that the ports are aligned with the spaces. This ensures that the ports are able to direct their jets of air between the deflector lugs so that there is an advantageous combination of the mechanical guiding action due to the deflector lugs and the reliable pressing of the material against the cylinder bearing the grippers.

In accordance with the invention it is possible for at least one journal of the cylinder fitted with the ports to be provided with at least one radially opening connection hole joined with the ports rotatively fitting around the journal so that the inner end of a supply duct in the block is swept over by an end opening of the connection hole in the cylinder, said supply duct being adapted to be connected with a means for producing a pressure difference. This features leads to a simple automatic control of the turning on and off of the ports owing the rotation of the cylinder.

It is preferred for the block to be able to be set angularly about the axis of the associated cylinder and to be locked against further angular motion when such adjustment has been performed, this making it a simple matter to retime the phase in which the ports are turned on.

Further advantageous features of the invention will be gathered from the claims.

A description will now be given of only one possible embodiment of the invention with reference to the drawings.

DETAILED DESCRIPTION OF THE PREFERRED EMBODIMENT

Figure 1:
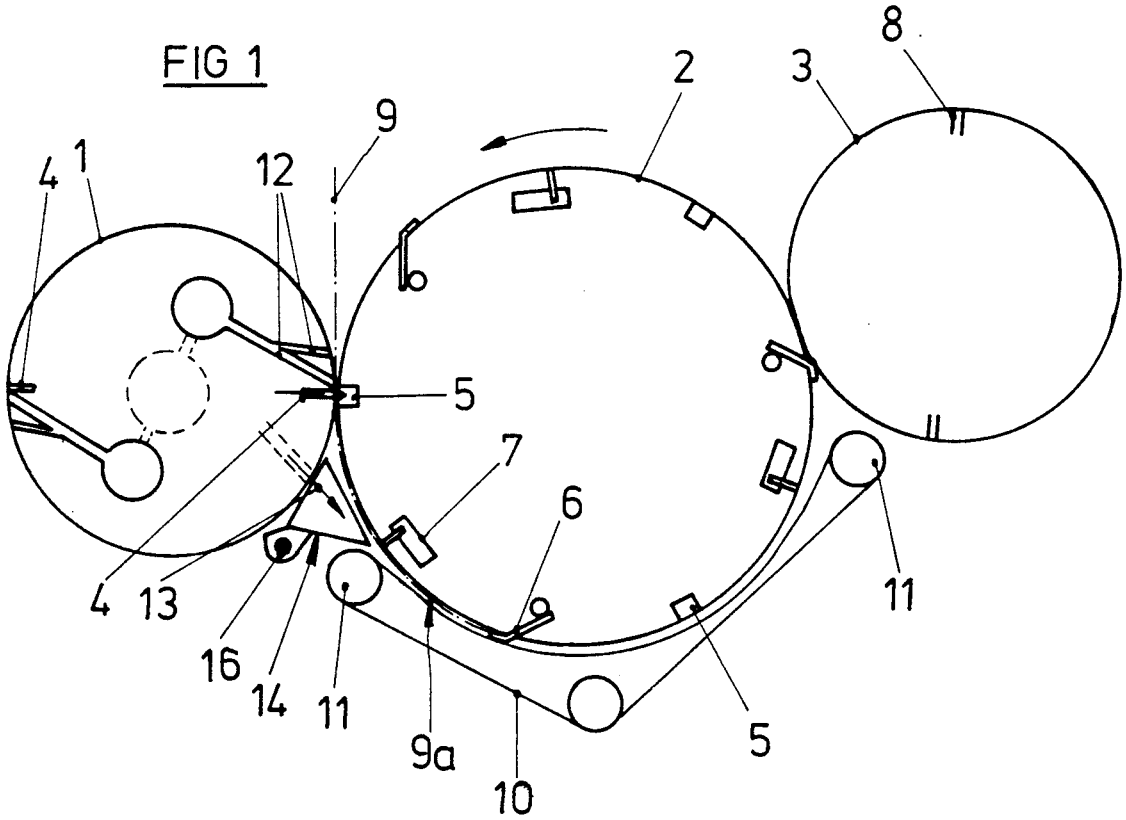
FIG. 1 is a diagrammatic side elevation of a folder in accordance with the invention.

The folder shown in FIG. 1 comprises a knife cylinder 1, a collect cylinder 2 arranged to make rolling engagement with it, and a folding jaw cylinder 3 cooperating the collect cylinder. The knife cylinder 1 is fitted with two knives 4 spaced from each other by an angle of 180° and which for making a transverse cut cooperate with mating knives 5, which are in the form of cutting grooves or counter holding rails or the like and which are arranged on the collect cylinder 2. The collect cylinder 2 is three-part cylinder and accordingly it has three counter knives offset by 120° from each other. The collect cylinder 2 is furthermore equipped with grippers 6 which are associated with the mating knifes 5 and are offset circumferentially therefrom forwards in the direction of rotation, and with folding blades 7 arranged between the grippers 6 and the associated mating knives 5. The folding blades 7 cooperate with the folding jaws 8 of the folding jaw cylinder 3, which like the knife cylinder 1 is in the form of a two-part cylinder.

The cylinders 1, 2 and 3 are driven so as to have the same surface speed which does not depend on the speed of the web 9 entering the cutting nip between the knife cylinder 1 and collect cylinder 2 so that different lenghts of section may be cut from the web. The grippers 6 and the folding blades 7 of the collect cylinder 2 are able to be adjusted in a manner dependent on the paper format. The grippers 6 are so operated that they only grip the leading product edge after the rear end has been parted from the web 9 by a transverse cut and the web section 9*a* so produced is able to be accelerated to the surface speed of the cylinder, which differs from the web speed.

The circumferential zone of the collect cylinder 2 extending from the knife cylinder 1 in the direction of rotation to the folding jaw cylinder 3 has a conveyor belt 10 trained over it, which is driven at the same surface speed as the surface speed of the cylinder. The conveyor belt 10 serves to hold the leading edge of the web or respectively, of the web sections 9, produced anew each time a transverse cut is made, in engagement with the collect cylinder 2 so that the grippers 6 are able to engage the leading edge of the section. The individual belt elements of the conveyor belt 10 are caused to change direction by the bend rolls 11 arranged between the exit part of the cutting nip between the knife cylinder 1 and the collect cylinder 2 and in the entry part of the folding cylinder 1 and the collect cylinder 2 and in the entry part of the folding nip between the collect cylinder 2 and the folding jaw cylinder 3.

There is necessarily a certain distance between the point of cutting and the adjacent bend roll 11. In order to reliably cause the loose or free web end produced every time a cut is made to engage the collect cylinder 2 before such end enters the gap between the conveyor belt 10 and the collect cylinder 2, and in order to prevent the web material curling, the knife cylinder 1 is provided with blowing ports 12 placed following the knives 4 of the cylinder. Such ports are provided with means connecting them with a source of compressed air when they move through the cutting gap and the widening gap following it. The back pressure of the air jets issuing from the ports 12 causes the web material to be urged against the collect cylinder 2, as is indicated in FIG. 1 by the arrow 13. The ports are simply formed by holes directed along a radious or along a secant which are connected with further holes or ducts so that there is a row of ports extending along in the circumferential direction. It would naturally be possible for the exit of each port to be formed by a nipple which could be adjusted to make each jet more intense. In the length direction of the cylinder the ports 12 are spaced out evenly. In addition or as an alternative to the ports 12 in the knife cylinder it would be possible for the collect cylinder 2 to be equipped with suction ports placed after the mating knives 5 and able to be connected with a vacuum line in order to draw the web material onto the collect cylinder 2.

Figure 2:
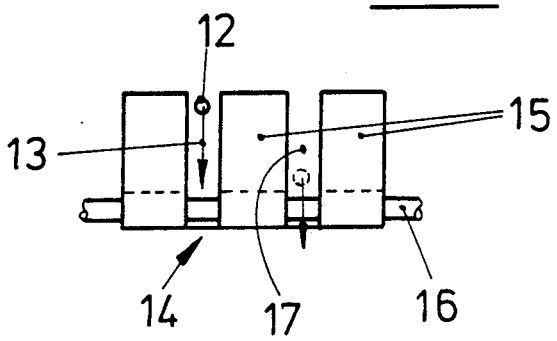
FIG. 2 is a plan view of the stationary deflector means.

In the illustrated working example of the invention there is a stationary deflecting means 14 bridging over the distance between the cutting nip and the conveyor belt 10 and placed in the widening gap following the said nip. This deflector means 14 serves to mechanically guide the material coming out of the cutting nip. As will best be seen from FIG. 2, this deflecting means is made up of a plurality of spaced deflecting lugs 15. The distances between the lugs are such that the blowing ports are able to direct air jets between them as is indicated by the narrow 13 in FIG. 2. The ports 12 are accordingly arranged so that they are aligned with the spaces between the lugs 15. The deflecting lugs 15 are mounted on a crosspiece 16 extending across the width of the machine. The crosspiece is, as may be seen from FIG. 1, so arranged that it is not in the way of air jets blowing through the spaces 17 between the individual deflecting lugs 15, that is to say the flanks of the deflecting lugs 15 (which are generally triangular in cross section) on the cylinder side are at least partly left free.

Figure 3:
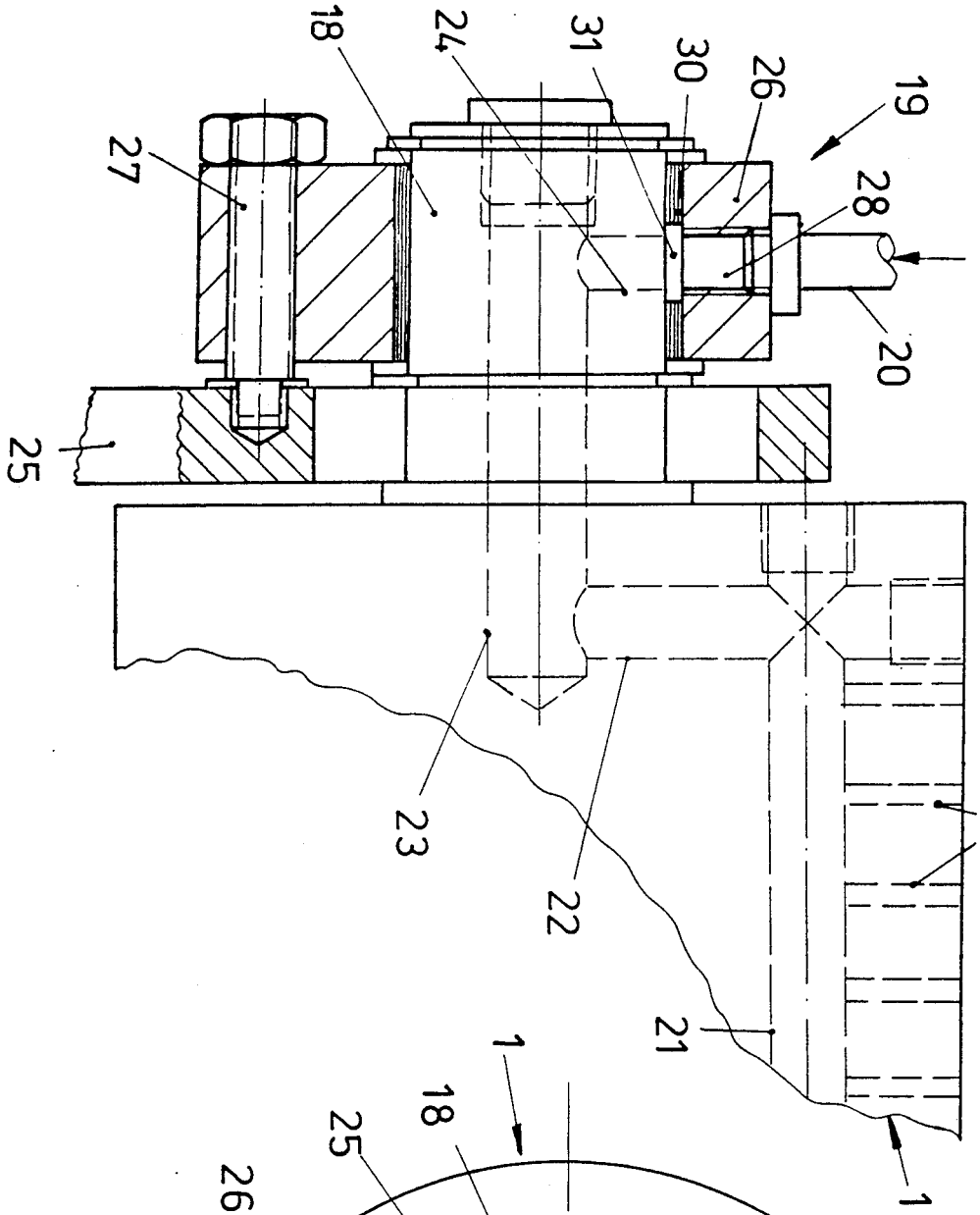
FIG. 3 is a plan view of the knife cylinder provided with blowing ports.

As will best be seen from FIG. 3 the ports 12 are connected via a rotary feedthrough 19 on the journals 18 of the knife cylinder 1 and a system of ducts in the cylinder 1 with a source of compressed air, which in the present case is in the form of the plant air line system 20. In order to ensure simple automatic timing of the supply of compressed air to the ports 12 when the ports move through the cutting nip and the widening gap following such nip, the ports associated with the mutually offset knives 4 of the knife cylinder may be supplied with compressed air via their oun rotary feedthrough 19 of holes in the same or different journals 18 and the systems of holes associated with same. As will further be seen from FIG. 3 the system of holes or ducts are associated with the ports 12 and placed after one repective knife 4 leads from the radial holes forming the ports 12 to a teminally sealed axial hole 21 which extends along the length of the cylinder and from which the radial holes extend forming the ports 12. This axial hole is connected via a circumferentially sealed radial hole 22 with a central axially directed blind hole 23 sealed at the axial end and from which a radial connection hole 24 extends. This connection hole 24 is in a prolongation of the journal 18 extending past the wall of the machine frame 25.

The rotary feedthrough 19 comprises a block 26 having a hole concentric to the cylinder and placed around the extensions of the journal 18 containing the connection hole 24. The block 26 which may be turned about the axis of the cylinder for resetting is connected with the adjacent frame wall 25 by means of a retaining screw 27 and thus prevented from turning with the wall. In the axial direction the block 26 is held in place by clamping rings and spacer bushings. The said block 26 is provided with a radial hole forming a supply duct 28 whose peripheral end is connected with the compressed air line and which extends as far as the hole, concentric to the cylinder axis, of the block 26. The inner opening here of the supply duct 28 is accordingly swept over by the end of the connection hole during every revolution of the knife cylinder 1, such hole end being at the circumference of the journal 18. When the opening is swept over by the hole end the ports 12 are connected with the compressed air supply. In order to connect the compressed air duct 20 with the outer end of the supply duct 28 it is possible to have a connection nipple.

Figure 4:
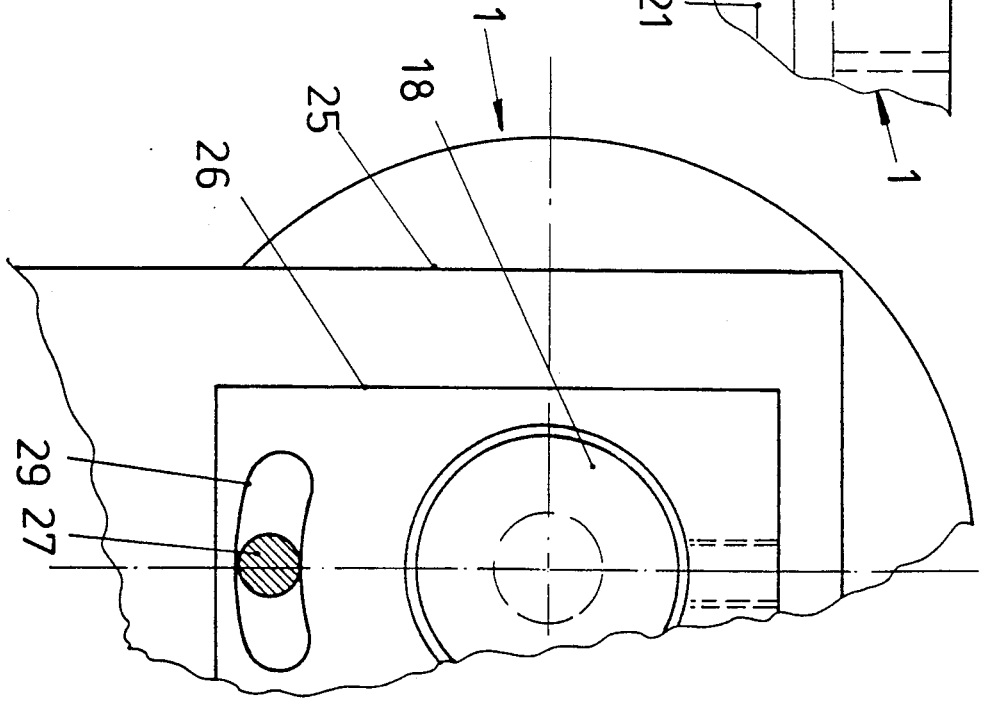
FIG. 4 is an end-on view of the knife cylinder.

In order reset the angular range in which the ports 12 are to be supplied with compressed air it is only necessary to slacken off the retaining screw 27 and to turn the block 26 into the desired position. As may best be seen from FIG. 4, the block 26 is provided with a curved slot 29 concentric to the cylinder axis and having the retaining screw 27 passing through it.

In the illustrated form of the invention a bushing 30 is inserted into the block 26 which has a peripheral pocket 31 into which the supply duct 28 opens. In effect this pocket 31 practically forms a timing chamber for the prolongation of the period of supply of compressed air to the ports 10 past the angular range corresponding to the diameter of the supply duct 28. The pocket 31 accordingly subtends an angle which is generally equal to the angular distance between the cutting nip and the adjacent bend roll 11.

I claim:

1. A mechanism for an adjustable folding apparatus comprising:

a knife cylinder;

means for causing the knife cylinder to rotate at a speed independent of the supply of a web to be processed;

a mating cylinder with which said knife cylinder is adapted to cooperate at a cutting nip for the production of cut sections from the web and which is provided with grippers to engage and hold leading edges of said cut sections;

a conveyor belt trained about said mating cylinder on a peripheral part thereof extending from said cutting nip, at least one of said knife cylinders forming said cutting nip being provided with ports coming after cutting means on said one cylinder, said ports being adapted to produce a flow of air, said flow of air being directed towards said mating cylinder with said grippers, said ports including blowing ports which are at least present in said knife cylinder in a part of the periphery thereof arranged after said mating knives and directed towards said mating cylinder, said ports having means for connection with a compressed air supply; and a staionary deflecting means arranged in a widening gap following said cutting nip and ahead of said conveyor belt, said deflecting means including deflector lugs which have spaces between them such that the blowing ports are aligned with the spaces.

2. The mechanism as claimed in claim 1 comprising air flow timing means arranged to activate said ports on moving through said cutting nip and in a widening gap between the cylinders following such nip and to inactive said ports when same are clear of said nip and said gap.

3. The mechanism as claimed in claim 1 comprising a common crosspiece extending between two sides of the deflector means and having said deflector lugs mounted thereon, said crosspiece leaving flanks of the lugs on the cylinder side at least partly.

4. The mechanism as claimed in claim 1 wherein the flowing ports are arranged in plurality of rows.

5. The mechanism as claimed in claim 1 wherein said at least one cylinder having such ports includes at least one journal which has a radially opening connection hole therein connected with such ports and said cutting mechanism further includes a block arranged around said at least one journal and having a duct therein adapted with a pump so as to cause a pressure in said duct to be different from an atmospheric pressure, said duct having an inner end adapted to be swept over by an outer end of said connection hole in said journal.

6. The mechanism as claimed in claim 5 wherein said block is mounted so as to be able to be rivoted about the axis of said journal and is provided with means for locking it and preventing further rivoting motion.

7. The mechanism as claimed in claim 5 wherein said air supply duct is directed into a timing chamber whose peripheral extent is larger than the diameter of the connection hole moving past it.

8. The mechanism as claimed in claim 7 comprising a bushing mounted in the block and defining said timing chamber therein.

* * * * *